US006736572B2

(12) United States Patent
Geraghty

(10) Patent No.: US 6,736,572 B2
(45) Date of Patent: May 18, 2004

(54) METHOD AND APPARATUS FOR REDUCING THE POLLUTION OF BOAT HARBORS

(76) Inventor: Brian Geraghty, 59 Willow Tree Pl., Grosse Pointe Shores, MI (US) 48236

( * ) Notice: Subject to any disclaimer, the term of this patent is extended or adjusted under 35 U.S.C. 154(b) by 88 days.

(21) Appl. No.: 09/907,992

(22) Filed: Jul. 18, 2001

(65) Prior Publication Data

US 2003/0017002 A1 Jan. 23, 2003

(51) Int. Cl.[7] ..... E02B 15/00
(52) U.S. Cl. ..... 405/211; 405/80; 405/60
(58) Field of Search ..... 405/62, 60, 61, 405/73, 74, 80, 81, 211, 211.1

(56) References Cited

U.S. PATENT DOCUMENTS 2,751,881 A * 6/1956 Burkey ..... 119/219
2,761,421 A * 9/1956 Burkey ..... 119/219
3,713,542 A 1/1973 Shaler et al.
3,785,159 A 1/1974 Hammond
3,884,810 A * 5/1975 Smyrnow ..... 405/62
4,405,259 A * 9/1983 Koskivirta et al. ..... 405/62
4,879,046 A 11/1989 Kojima
4,943,186 A 7/1990 Van Weezenbeek
4,957,392 A * 9/1990 Bailard et al. ..... 405/73
5,673,449 A * 10/1997 Henriksson et al. ..... 405/80
5,839,853 A * 11/1998 Oppenheimer et al. ..... 405/60
5,893,978 A 4/1999 Yoda et al.

* cited by examiner

*Primary Examiner*—Frederick L. Lagman
(74) *Attorney, Agent, or Firm*—Brooks Kushman P.C.

(57) ABSTRACT

A method for inhibiting the pollution of a harbor having an entrance interfacing a moving body of water in which jet streams of water are generated near the surface. The jet streams of water displacing the surface water and the floating debris away from the harbor's entrance significantly reducing the collection of debris in the harbor.

9 Claims, 4 Drawing Sheets

METHOD AND APPARATUS FOR REDUCING THE POLLUTION OF BOAT HARBORS

BACKGROUND OF THE INVENTION

1. Field of the Invention

The invention is related to the field of preventing pollution of isolated areas of water and in particular to boat harbors having an opening or entrance interfacing a moving body of water such as a stream or river.

2. Background Art

Boat harbors having an entrance interfacing a larger body of water are often polluted with floating algae and debris. This condition is aggravated when the entrance to the harbor interfaces a moving body of water, such as a river, which induces an eddy within the confines of the harbor. As anyone who has ever walked along the edge a stream will observe, these eddies circulate within isolated areas and often are filled with debris. The circular motion of the eddy currents effectively inhibit the escape of the collected debris back into the stream.

The collected debris, over a period of time, pollutes the harbor, stains the boats and often gives rise to a foul odor. The floating debris may include algae, dead fish, seaweed, tree leaves, tree branches and other material, both natural or manmade.

Mechanical barriers to inhibit the entrance of debris into the harbor and prevent its pollution are impractical since they would have to be moved out of the way or lowered each time a boat enters or leaves the harbor. Alternatively, the harbor must be cleaned periodically. This process could be a costly and time-consuming since it might require moving the docked boats.

SUMMARY OF THE INVENTION

The invention is a method and apparatus for inhibiting surface pollutants from entering a quiescent body of water, such as a harbor, which has an entrance interfacing a moving body of water such as a river. The method consists of generating a jet stream of water at the surface of the moving body of water, which diverts the surface water and the debris carried therein away from the entrance to the harbor. By diverting the surface layer of the moving body of water away from the entrance to the harbor, pollutants and floating debris are inhibited from entering the harbor and polluting the waters contained therein.

It is an object of the invention to inhibit the pollution of an isolated area of water interfacing a moving body of water.

It is another object of the invention is to divert the water adjacent to the surface of a moving body of water away from the entrance to a harbor to prevent pollution thereof.

Another object of the invention is to use hydraulic pumps to generate jet streams of water on opposite sides of the entrance to a harbor to divert the water at the surface adjacent to the opening in a direction away from the harbor.

Yet another object of the invention is to induce a current in the harbor effective in the removal of pollutants.

These and other objects will become more apparent from a reading of the specification in conjunction with the drawings.

DETAILED DESCRIPTION OF THE PREFERRED EMBODIMENT(S)

Figure 1:
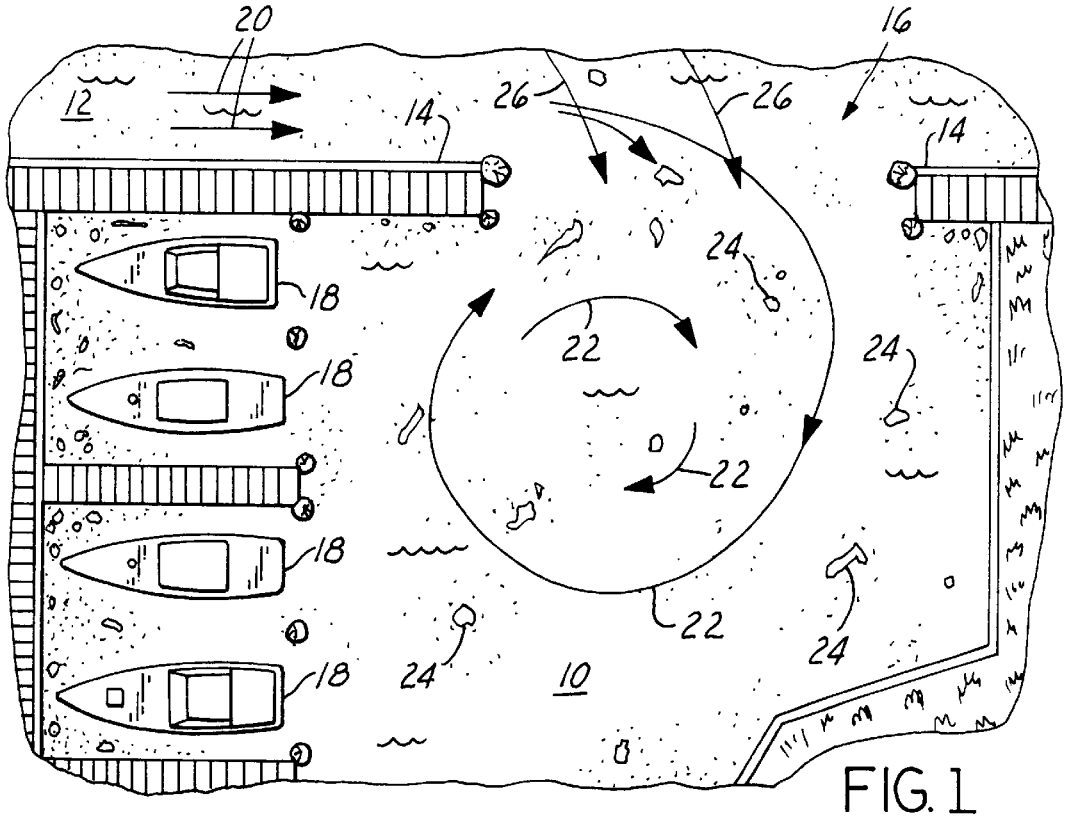
FIG. 1 illustrates the surface currents in a harbor having an entrance interfacing a moving body of water.

FIG. 1 illustrates a typical boat harbor 10 located alongside of a moving body of water 12. In particular, the harbor 10 is located alongside a river, in particular, the Detroit River. A seawall 14 separates the harbor 10 from the river 12. The seawall 14 is interrupted by a harbor entrance 16 which permits boats 18 to freely enter and exit the harbor. The water flows in the river in the direction included by arrow 20. As is known, the flowing water in the river will induce an eddy to flow in the harbor 10 as indicated by arrows 22. This eddy 22 is circular and inhibits the debris 24 floating on the surface of the water in the harbor from flowing back in to the river 12. Further, in the presence of an on-shore wind indicated by arrows 26, floating debris can be blown into the harbor 10 through entrance 16 and trapped there in the eddy current.

Figure 2:
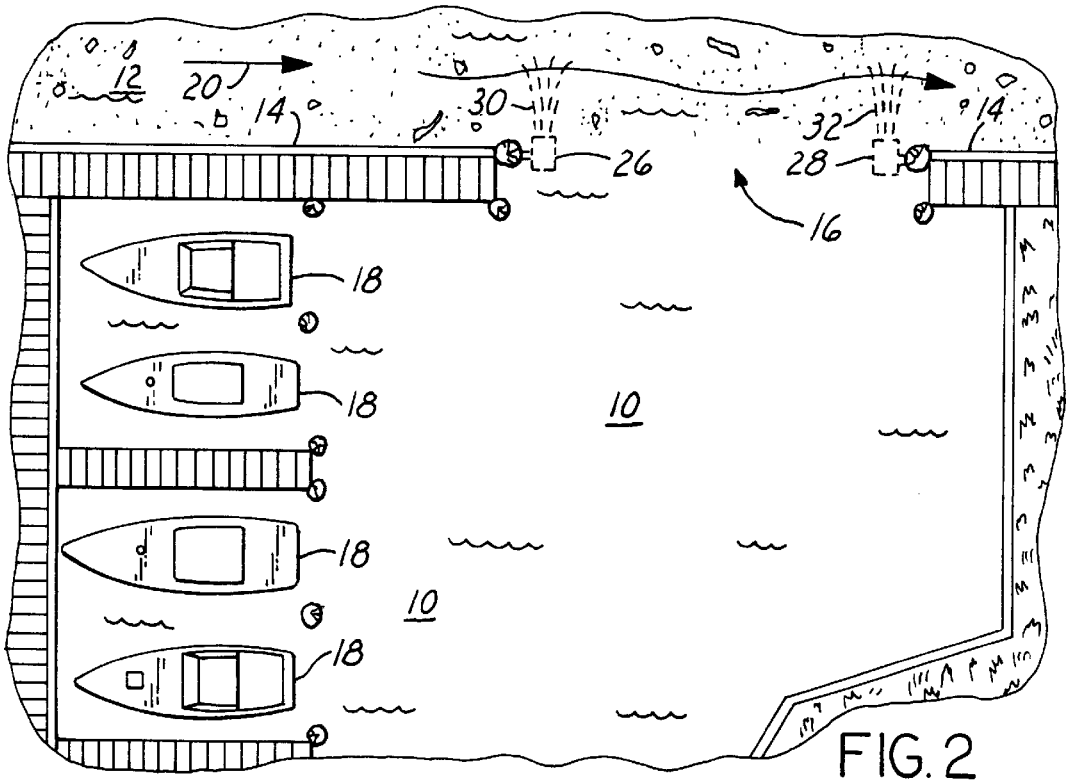
FIG. 2 shows the surface currents adjacent to the entrance to a harbor embodying the invention.

A first embodiment of the invention is shown in FIG. 2. In this embodiment, a pair of hydraulic pumps 26 and 28 are mounted to the pier 14 on opposite sides of the entrance 16. The hydraulic pumps 26 and 28 produce jet streams of water 30 and 32 at the surface of the river 12 in a direction away from the harbor 10. The hydraulic pumps 26 and 28 are preferably mounted about 30 centimeters (1 foot) below the surface of the water but may be located at a lesser or greater depth depending upon the width of the entrance 16 and the velocity of the river's current.

Alternatively, the pumps 26 and 28 alternatively may be located to produce the jet streams 30 and 32 slightly above the water level to produce a similar result. In the embodiment illustrated in FIG. 2, the jet streams of water 30 and 32 are directed in a direction normal to the direction of the river current 20. However, it is to be understood that the directions of the jet streams 30 and 32 may be at an angle different than perpendicular to direction of the river flow to maximize the efficiency of the jet streams 30 and 32 in inhibiting debris 24 from entering the harbor 10. Also, the direction of jet stream 30 may be different from jet stream 32.

The jet streams 30 and 32 divert the water at the surface of the river 12 and the debris being carried therein away from the harbor's entrance 16 significantly reducing the pollution of the water in the harbor 10. Although the embodiment shown in FIG. 2 has two hydraulic pumps 26 and 28, harbors having narrower entrances 16 may only require one hydraulic pump, while larger entrances 16 may require more than two hydraulic pumps.

Figure 3:
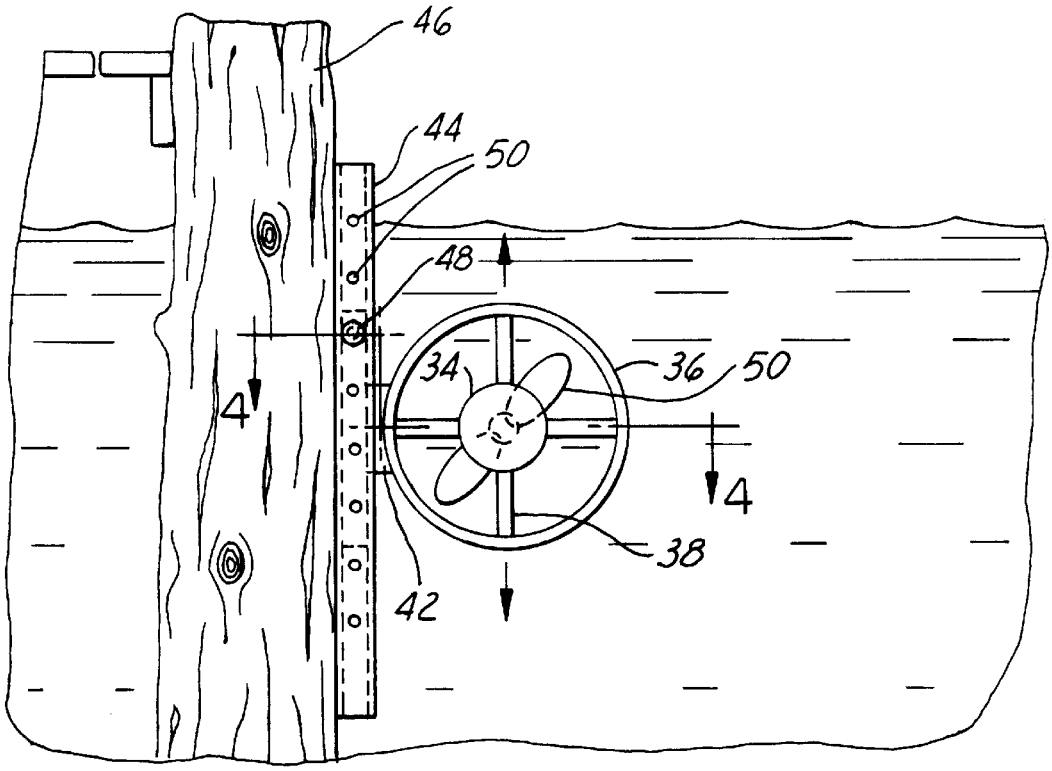
FIG. 3 is a side view of the hydraulic pump assembly.
Figure 4:
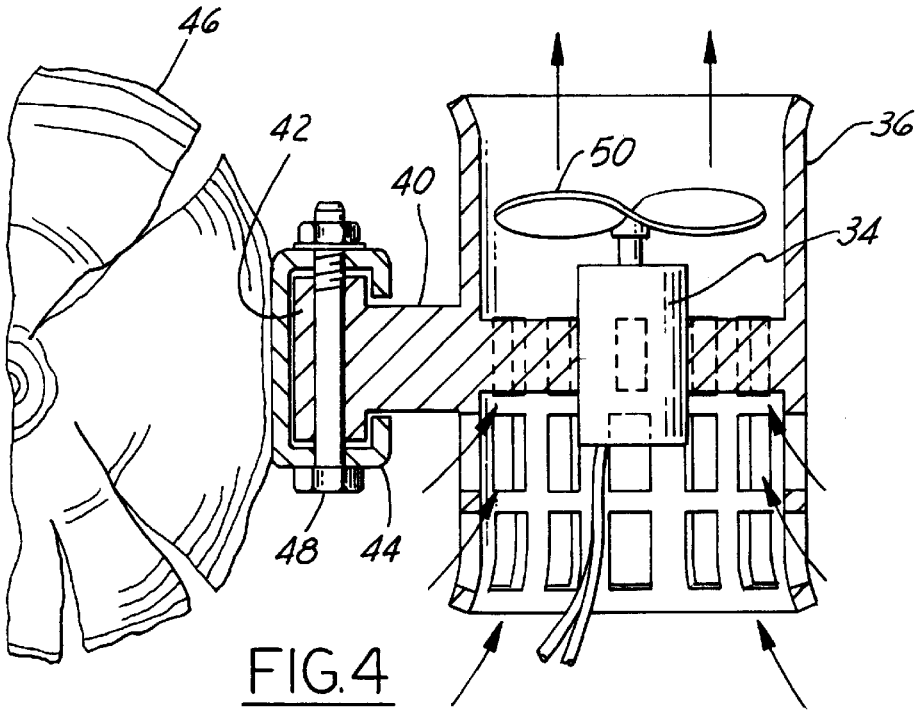
FIG. 4 is a cross-sectional view of the hydraulic pump assembly taken along section lines 4—4.

The details of the hydraulic pumps 26 and 28 are shown on FIGS. 3 and 4. The pumps 26 and 28 have a motor 34 enclosed in a shroud 36 the axis of which defines the direction of the generated jet streams of water 30 or 32. The motor 34 is supported within the shroud 36 by a set of radially extending vanes 38. The shroud 36 has a mounting foot 40 having a T-shaped cross-section as shown on FIG. 4. The head 42 of the T-shaped mounting foot 40 is receivable in a channel bracket 44 fixedly attached to a post 46 adjacent to the entrance 16 to the harbor. One or more bolts 48 secure the mounting foot 42 to the channel bracket 44. The mounting bracket 44 may have a series of vertically displaced bolt holes 48 which permit the location of the pump to be moved up or down to compensate for seasonal changes in the depth of the water in the river 12.

The motor 34 drives a propeller 50 which produces the jet stream of water in the shroud 36. The motor 34 may be a submersible electric motor, however, hydraulic or pneumatic motors may be used. In the embodiment shown in FIGS. 3 and 4, the pump and shroud is a submersible pump assembly commercially available under the trademark ICE EATER™ from Power House, Inc. of Owings Mills, Md. The motor is a one-horsepower, 120-volt AC, submersible, electric motor. Alternatively, the pump may be a centrifugal pump or any other type of high volume fluid pump known in the art.

Figure 5:
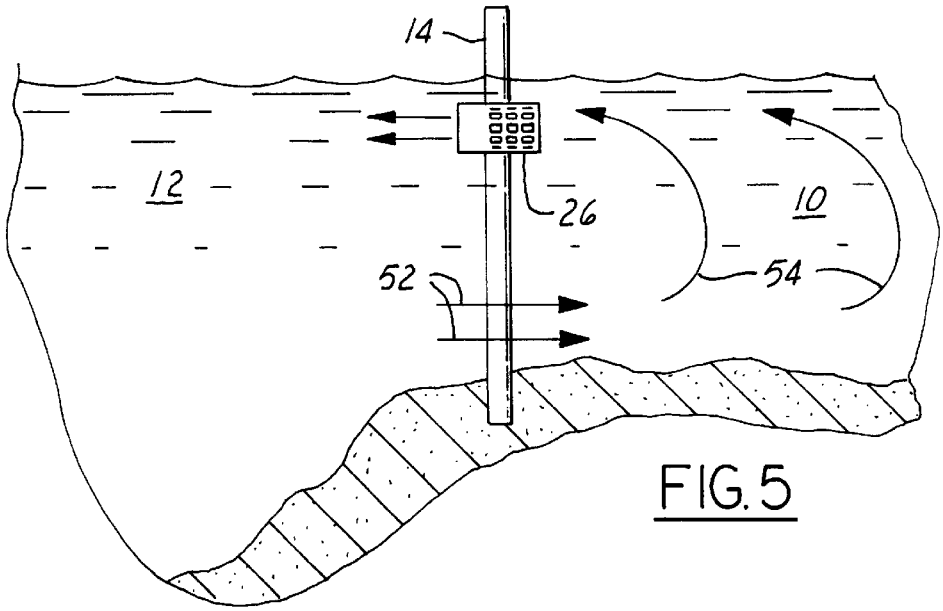
FIG. 5 illustrates the vertical circulation of the water in the harbor produced by the invention.

The function of the pumped jet stream of water is to generate a surface fluid flow away from the harbor's entrance 16. As illustrated in FIG. 5, the water expelled by the pumps 26 and 28 is replaced in the harbor 16 at a lower level as indicated by arrows 52. This further induces a fluid flow in a vertical plane in the harbor as indicated by arrows 54 in FIG. 5 which effectively cleanses the harbor 16 of any collected pollution.

Figure 6:
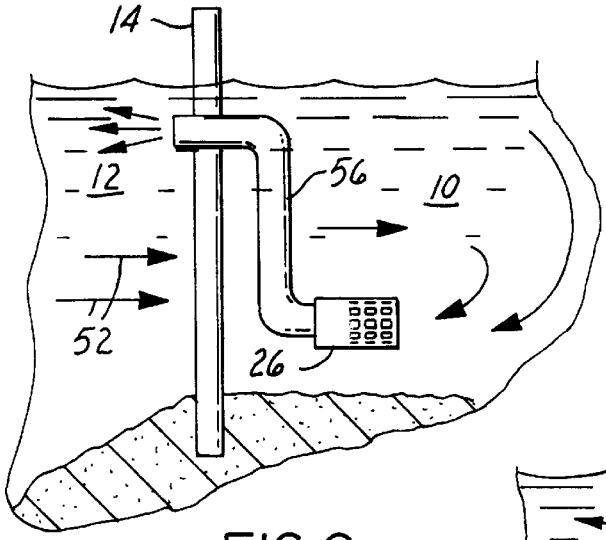
FIG. 6 is a side view of a second embodiment of the invention with the pump remotely located.
Figure 7:
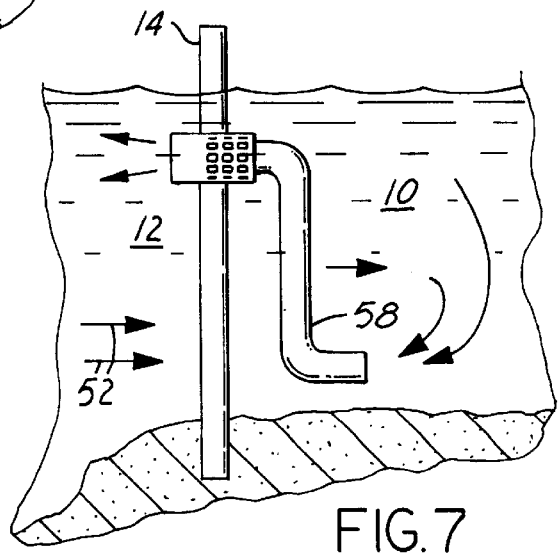
FIG. 7 is a side view of a third embodiment having a remotely located inlet to the hydraulic pump.

In order to more effectively ensure this fluid flow in the vertical plane, the pump itself may be mounted at a remote location nearer the bottom of the harbor and the jet stream directed by a pipe 56 to the desired location near the surface of the water at the harbor's entrance as shown in FIG. 6. Conversely, the pump 26 or 28 may be located near the surface of the water as illustrated in FIG. 7 and the inlet to the pump ducted to a lower level in the harbor by pipe 58.

Various combinations of pumps and ducting may be employed to induce a water flow at the surface of the entrance away from the harbor to significantly reduce floating pollutants and debris from entering into and polluting the harbor.

Figure 8:
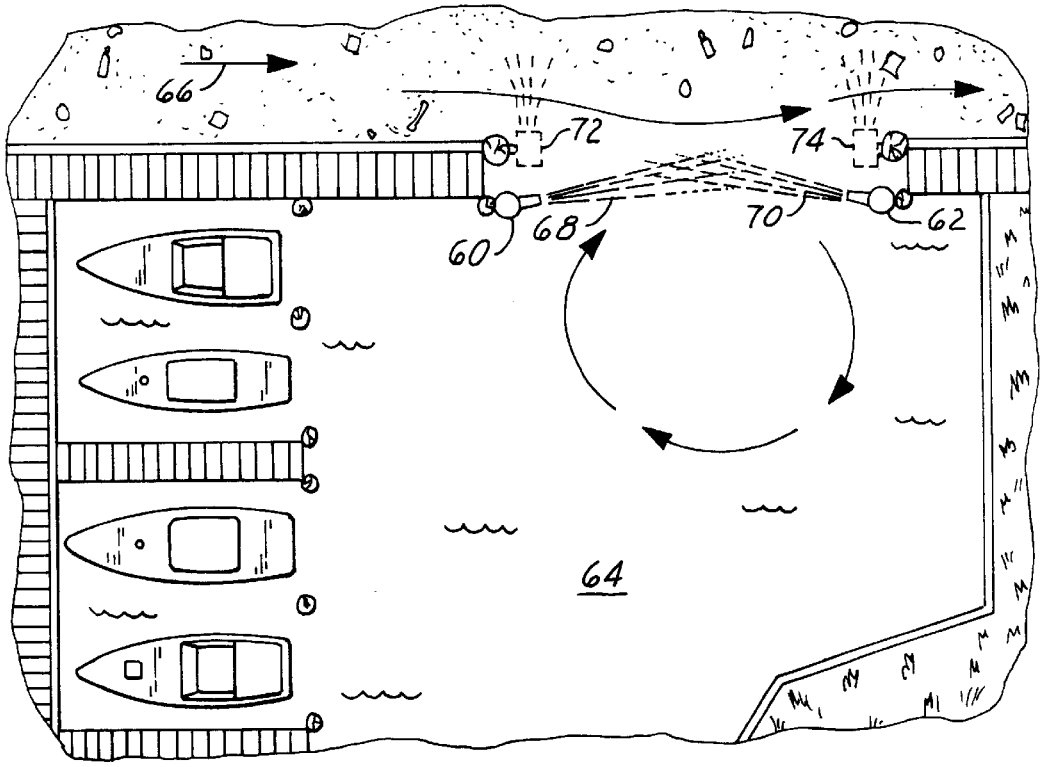
FIG. 8 is a plan view of a fourth embodiment.
Figure 9:
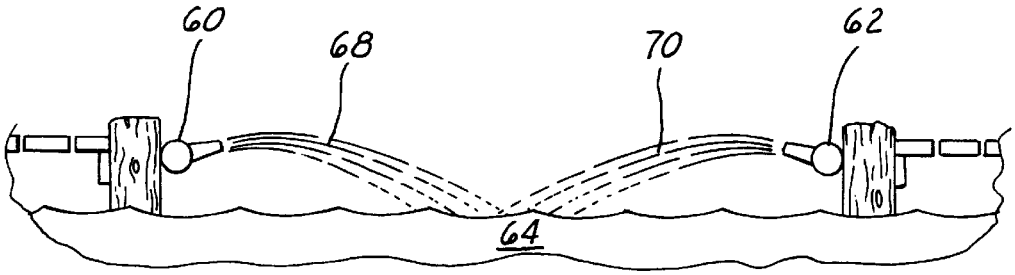
FIG. 9 is an elevation of the fourth embodiment of FIG. 8.

In FIGS. 8 and 9, I have shown a pair of nozzles 60 and 62 disposed at opposite sides of a wide entrance to a harbor or bay 64 opening onto a river flowing in the direction 66. Pumps (not shown) connected to the nozzles deliver water under pressure thereto. The nozzles are aimed across the entrance to create streams 68 and 70 directed to impinge on the harbor water near the middle of the harbor entrance to drive the surface water and pollutants out of the harbor into the river and prevent pollutants from entering at the center of the entrance. Pumps 72 and 74 similar to those previously described may also be utilized. This embodiment is particularly intended for wide harbor entrances. A greater or lesser number of nozzles may be provided as desired.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method for inhibiting the pollution of a harbor having an entrance interfacing a moving body of water comprising generating at least two jet streams of water near the surface of the moving body of water, one jet stream of water of the at least two jet streams of water being adjacent to each edge of the entrance to the harbor, the at least two jet streams of water being generated in a direction away from the harbor normal to the direction of flow of the moving body of water.

2. The method of claim 1 wherein the jet streams of water are generated at a location within 30 cm of the surface of the moving body of water.

3. The method of claim 1 wherein the jet streams are generated at a depth within 30 cm of the surface of the water.

4. The method of claim 1 wherein the jet streams of water are generated by hydraulic pumps.

5. An apparatus for inhibiting the pollution of a harbor having an entrance interfacing a moving body of water, the apparatus comprising at least two hydraulic pumps one associated with each side of the entrance to the harbor, both of the at least two hydraulic pumps generating a jet stream of water adjacent the upper surface of the moving body of water in a direction away from the harbor and normal to the direction of flow of the moving body of water; the jet streams of water diverting the water at the surface of the moving body of water away from the entrance to the harbor.

6. The apparatus of claim 5 wherein the two hydraulic pumps are disposed on opposite sides of the entrance to the harbor at a depth approximately 30 cm below the surface of the moving body of water.

7. The apparatus of claim 6 wherein the two hydraulic pumps have inlets connected by pipes to remote locations in the harbor.

8. The apparatus of claim 5 wherein the at least two hydraulic pumps are remotely located and the jet stream of water generated by the hydraulic pumps are directed by pipes to locations on opposite sides of the entrance to the harbor.

9. The apparatus of claim 5 wherein the at least two hydraulic pumps are water immersible electrically powered pumps.

* * * * *